US008477079B2

(12) United States Patent
Carr

(10) Patent No.: US 8,477,079 B2
(45) Date of Patent: Jul. 2, 2013

(54) MULTIPLE-CAVITY ANTENNA

(76) Inventor: William N. Carr, Montclair, NJ (US)

( * ) Notice: Subject to any disclaimer, the term of this patent is extended or adjusted under 35 U.S.C. 154(b) by 604 days.

(21) Appl. No.: 12/706,660

(22) Filed: Feb. 16, 2010

(65) Prior Publication Data

US 2010/0207840 A1 Aug. 19, 2010

Related U.S. Application Data

(63) Continuation-in-part of application No. 12/621,451, filed on Nov. 18, 2009, now Pat. No. 8,384,599, which is a continuation-in-part of application No. 12/535,768, filed on Aug. 5, 2009, now Pat. No. 8,284,104.

(60) Provisional application No. 61/207,909, filed on Feb. 19, 2009, provisional application No. 61/207,467, filed on Feb. 13, 2009, provisional application No. 61/214,200, filed on Apr. 22, 2009, provisional application No. 61/273,814, filed on Aug. 10, 2009.

(51) Int. Cl.
*H01Q 1/00* (2006.01)

(52) U.S. Cl.
USPC ..... 343/904; 343/906; 343/908; 343/700 MS

(58) Field of Classification Search
USPC ..... 343/904, 700 MS, 908, 906
See application file for complete search history.

(56) References Cited

U.S. PATENT DOCUMENTS

| | | | | |
|---|---|---|---|---|
| 4,128,840 | A | 12/1978 | Tucker | |
| 4,259,670 | A | 3/1981 | Schiavone | |
| 4,356,492 | A | 10/1982 | Kaloi | |
| 4,704,581 | A | 11/1987 | Clark | |
| 4,783,661 | A | 11/1988 | Smith | |
| 5,283,589 | A | 2/1994 | Blevins | |
| 5,341,148 | A | 8/1994 | Walter et al. | |
| 5,471,180 | A | 11/1995 | Brommer et al. | |
| 5,995,048 | A * | 11/1999 | Smithgall et al. | 343/700 MS |
| 6,342,864 | B1 | 1/2002 | Muramoto et al. | |
| 6,552,693 | B1 | 4/2003 | Leisten | |
| 6,975,276 | B2 | 12/2005 | Brown | |
| 7,019,711 | B2 | 3/2006 | Johnson et al. | |
| 7,034,752 | B2 | 4/2006 | Sekiguchi et al. | |

(Continued)

FOREIGN PATENT DOCUMENTS

WO 2004093249 A1 10/2004

OTHER PUBLICATIONS

Young, Lee W., "PCT Application No. PCT/US 10/00441 International Search Report Apr. 7, 2010", , Publisher: PCT, Published in: PCT.

(Continued)

*Primary Examiner* — Douglas W Owens
*Assistant Examiner* — Collin Dawkins
(74) *Attorney, Agent, or Firm* — Kaplan Breyer Schwarz & Ottesen, LLP

(57) ABSTRACT

An antenna for a Radio-Frequency IDentification (RFID) system is disclosed that comprises a resonant structure, an RFID load element, and a floating coupling element. One of the two terminals of the RFID load element is connected directly to the resonant structure, and the other terminal is connected to the floating coupling element. The floating coupling element is electrically isolated from the resonant structure; its presence provides an improved impedance match to the RFID load element.

20 Claims, 3 Drawing Sheets

U.S. PATENT DOCUMENTS

| | | | | |
|---|---|---|---|---|
| 7,088,290 | B2 | 8/2006 | Ohno et al. | |
| 7,173,577 | B2 | 2/2007 | Brown et al. | |
| 7,388,550 | B2 | 6/2008 | McLean | |
| 7,471,247 | B2 | 12/2008 | Saily et al. | |
| 7,589,678 | B2 | 9/2009 | Perunka et al. | |
| 7,619,570 | B1 | 11/2009 | Sarehraz et al. | |
| 2002/0057222 | A1 | 5/2002 | McKinzie, III et al. | |
| 2002/0167282 | A1 | 11/2002 | Kirkpatrick et al. | |
| 2003/0058178 | A1 | 3/2003 | Von Alpen et al. | |
| 2003/0169204 | A1* | 9/2003 | Saito | 343/700 MS |
| 2003/0201942 | A1 | 10/2003 | Poilasne et al. | |
| 2003/0210190 | A1* | 11/2003 | Lai | 343/702 |
| 2004/0021605 | A1* | 2/2004 | Kouam et al. | 343/700 MS |
| 2004/0070541 | A1 | 4/2004 | Andersson et al. | |
| 2005/0052283 | A1* | 3/2005 | Collins et al. | 340/572.7 |
| 2005/0057415 | A1 | 3/2005 | Rawnick et al. | |
| 2006/0181475 | A1* | 8/2006 | Kwon et al. | 343/793 |
| 2007/0109201 | A1 | 5/2007 | Licul et al. | |
| 2007/0210976 | A1 | 9/2007 | Luk et al. | |
| 2007/0290941 | A1 | 12/2007 | Brown et al. | |
| 2008/0122631 | A1 | 5/2008 | Kodukula et al. | |
| 2008/0191950 | A1 | 8/2008 | Chang et al. | |
| 2008/0284656 | A1 | 11/2008 | Petropoulos | |
| 2010/0013718 | A1 | 1/2010 | Zhu et al. | |
| 2010/0207840 | A1 | 8/2010 | Carr | |
| 2010/0207841 | A1 | 8/2010 | Carr | |

OTHER PUBLICATIONS

Young, Lee W., "PCT Application No. PCT/US 10/00424 International Search Report Apr. 9, 2010", , Publisher: PCT, Published in: PCT.

Carr, William N., "U.S. Appl. No. 12/462,428, filed Aug. 5, 2009", , Publisher: USPTO, Published in: US.

Athina Nickitas-Etienne, "PCT Application No. PCT/US2010/000441 International Preliminary Report on Patentability", , Publisher: PCT, Published in: PCT.

Beate Giffo-Schmitt, "PCT Application No. PCT/US2010/000424 International Preliminary Report on Patentability", , Publisher: PCT, Published in: PCT.

Islam, Hasan Z., "U.S. Appl. No. 12/535,768 Office Action Mar. 2, 2012", , Publisher: USPTO, Published in: US.

Dinh, Trinh Vo, "U.S. Appl. No. 12/621,451 Office Action May 10, 2012"Publisher: USPTO, Published in: US.

* cited by examiner

Monopole antenna 100 resonant structure 200

Folded-dipole antenna 300

Single-cavity antenna with load element 400

Single-cavity antenna with floating element 500

Single-cavity antenna with floating element and dielectric 600

MULTIPLE-CAVITY ANTENNA

CROSS REFERENCE TO RELATED APPLICATIONS

This case claims priority of the following provisional applications:

(1) U.S. provisional application No. 61/207,467; and (2) U.S. provisional application No. 61/273,814.

This case is a Continuation-in-Part and claims priority of co-pending U.S. Ser. No. 12/621,451 titled "Multiple-Cavity Antenna" and filed on Nov. 18, 2009.

This case claims priority to PCT case titled "Multiple-Cavity Antenna", which was submitted to the USPTO/Mail Stop PCT on Feb. 15, 2010 via FedEx Airbill 8682 2381 6624.

FIELD OF THE INVENTION

The present invention relates to antenna design for radio communication in general, and, more particularly, to antenna design for Radio-Frequency IDentification (RFID) systems.

BACKGROUND OF THE INVENTION

Radio communication systems have existed for over a century. During this period of time, antenna designers have generated a wide variety of antenna designs with the goal of achieving good performance in a variety of operating conditions.

Generally, the goal of the antenna designer when designing, for example, a receiving antenna, is to maximize power transfer between an electromagnetic signal incident on the antenna, and the resulting electrical signal generated by the antenna. The higher the power transfer, the higher the received signal-to-noise ratio, which usually results in better receiver performance.

Also, traditionally, radio receivers have comprised electronic circuitry and a separate receiving antenna interconnected to one another through a suitable cable connection. In such systems, antenna designers must consider the distorting influence of the cable connection and the electronic circuitry on the electromagnetic behavior of the antenna.

More recently, with the advent of small radio systems based on integrated circuit technology, it has become possible to make so-called Radio-Frequency IDentification (RFID) systems, wherein an entire radio receiver is housed in a package much smaller than the receiving antenna. In such systems, the almost-complete elimination of the distorting influence of the cable connection and the electronic circuitry enables novel antenna designs.

So-called passive RFID receivers can be much smaller than the receiving antenna in part because they do not require a power supply. Power to operate the receiver is derived from the received radio signal itself. The signal generated by the receiving antenna is rectified by one or more diodes to yield a direct-current (DC) voltage that is used to power the receiver.

Ideal diodes are perfect conductors when a forward voltage is applied and are perfect insulators when a reverse voltage is applied. Real diodes only approximate this behavior. In particular, real diodes require a minimum forward voltage before becoming good conductors. Accordingly, the signal generated by the receiving antenna, must have a voltage higher than the minimum required by the diodes, before a DC voltage becomes available to power the RFID receiver.

So, in contrast with traditional antenna design, the goal for the design of passive-RFID-receiver antennas is to maximize not the received-signal power, but rather the received-signal voltage.

It is well known in the art that antennas are reciprocal devices, meaning that an antenna that is used as a transmitting antenna can also be used as a receiving antenna, and vice versa. Furthermore, there is a one-to-one correspondence between the behavior of an antenna used as a receiving antenna and the behavior of the same antenna used as a transmitting antenna. This property of antennas is known in the art as "reciprocity."

An antenna used as a transmitting antenna accepts an electrical signal applied at an input port and produces a transmitted electromagnetic signal that propagates through three-dimensional space. It is well known in the art how to represent such a transmitted electromagnetic signal as a vector in a vector space, for example, as a superposition of spherical harmonics. The behavior of a transmitting antenna at a given frequency can be fully characterized by reporting, for example, the spherical-harmonic components of the transmitted electromagnetic signal that it generates in response to a test electrical signal at that frequency that is applied to the antenna's input port.

Such a characterization can be used to derive, unambiguously, the behavior of the same antenna when it is used as a receiving antenna. In this case, the input port becomes an output port that generates an output electrical signal in response to an incident electromagnetic signal propagating through three-dimensional space. The incident electromagnetic signal can be specified by, for example, by specifying its spherical-harmonic components. The resulting electrical signal can then be derived through a scalar product with the spherical-harmonic components of the transmitted electromagnetic signal at the same frequency, as is well known in the art.

A consequence of reciprocity is that an antenna can be fully characterized in terms of its properties as either a transmitting antenna or as a receiving antenna. A full characterization of an antenna when used in one mode (transmitting or receiving) uniquely and unambiguously defines the properties of the antenna when used in the other mode.

For example, in order to understand or measure the radiation pattern of an antenna it is frequently easier to feed an electric signal into the antenna and then observe the electromagnetic field generated by the antenna. This task can be performed experimentally or computationally. The radiation pattern of the antenna that is obtained through this method also applies when the antenna is used as a receiving antenna. Hereinafter, antennas will be interchangeably referred to as receiving or transmitting, and their properties will be discussed as they apply to either transmission or reception, as convenient to achieve clarity. It will be clear to those skilled in the art how to apply what is said about an antenna used in one mode (receiving or transmitting) to the same antenna used in the other mode.

FIG. 1 depicts monopole antenna 100 in accordance with the prior art. Monopole antenna 100 comprises monopole 110, ground plane 120 and co-axial cable connection 130. Monopole antenna 100 is a very common type of antenna and is representative of how many antennas operate. When an electrical signal is applied to co-axial cable connection 130, an electric field appears between monopole 110 and ground plane 120. If the electrical signal has a frequency at or near the so-called "resonant" frequency of the antenna, a large fraction of the power of the electrical signal is converted into an electromagnetic signal that is radiated by the antenna. If the electrical signal has a frequency that is substantially different from the resonant frequency of the antenna, a relatively small fraction of the signal's power is radiated; most of the power is reflected back into the co-axial cable connection.

In principle, it is possible to make an antenna that radiates efficiently at many frequencies, without exhibiting a band of resonance. In practice, it is difficult to make such antennas, and resonant structures (hereinafter also referred to as "resonators") are commonly used to make antennas that radiate efficiently.

FIG. 2 depicts resonant structure 200, which is an example of a type of resonant structure commonly used to make antennas in the prior art. Resonant structure 200 comprises a length of wire 240 bent in the shape of the letter U, with an input-output port 220 comprising connection points 230-1 and 230-2. As depicted in FIG. 2, the two connection points are attached to the two ends of the wire.

The frequency of resonance of resonant structure 200 depends on its length. The structure can be modeled as a twin-lead transmission line 210 with a short at one end (i.e., the end opposite input-output port 220). The structure is resonant at a frequency for which the length of the transmission line is about one quarter of a wavelength. The range of frequencies near the resonant frequency over which the resonant structure exhibits acceptably good performance is known as the "band of resonance."

Resonant structure 200 exhibits resonance in a manner similar to monopole antenna 100. Near the resonant frequency, the electromagnetic fields generated by the voltages and currents on wire 240 become stronger, and a larger fraction of the power of an electrical signal applied to input-output port 220 is radiated as an electromagnetic signal. Accordingly, resonant structures that exhibit this behavior are referred to as "electromagnetically-resonant."

FIG. 3 depicts folded-dipole antenna 300, which is an example of a common type of antenna in the prior art. Folded-dipole antenna 300 can be modeled as being composed of two instances of resonant structure 200 connected in series. When used as a transmitting antenna, an electrical signal is applied through balanced transmission line 320.

Although folded-dipole antenna 300 can be modeled as being composed of two instances of resonant structure 200 connected in series, the signal that it generates when used as a receiving antenna is not the sum of the signals that each instance of resonant structure 200 would generate if used by itself because of the mutual coupling between the two instances of resonant structure 200.

FIG. 4 depicts antenna-with-load-element 400, which is an example of a type of antenna in the prior art for RFID systems known as RFID tags. Antenna-with-load-element 400 comprises: conductive sheets 410-1, and 410-2, electrical connection 420, connection points 440-1 and 440-2, and load element 430, interrelated as shown.

Conductive sheets 410-1 and 410-2, together with electrical connection 420, form resonant structure 450. Load element 430 receives the signal generated by resonant structure 450 through connection points 440-1 and 440-2. When used to implement an RFID tag, load element 430 is small relatively to the size of conductive sheets 410-1 and 410-2.

To implement an RFID tag, load element 430 acts as both a receiver and a transmitter. In particular, in a passive RFID tag, transmission is accomplished through a technique known as "modulated backscatter" wherein load element 430 controls the impedance that it presents to the received signal. Modulated backscatter is based on the fact that, in any radio receiver, a portion of the electromagnetic signal incident on the receiving antenna is reflected. The amplitude and phase of the reflected signal depend on the impedance connected to the antenna port, so that load element 430 modulates the reflected signal by controlling its own impedance.

The impedance of an RFID load element depends on the design and implementation of the device and, typically, it is non-linear, meaning that is varies as a function of the amplitude of the applied signal. As a consequence, the goal of maximizing received-signal voltage is difficult to achieve. There is a need for methods to couple an antenna to an RFID load element that achieve the desired impedance match.

SUMMARY OF THE INVENTION

Embodiments of the present invention comprise a resonant structure, an RFID load element, and a floating coupling element. One of the two terminals of the RFID load element is connected directly to the resonant structure, and the other terminal is connected to the floating coupling element. The resonant structure can be realized, for example, as a resonant cavity, as is well known in the art. The floating coupling element is electrically isolated from the resonant structure, and its size, shape and position, relative to the resonant structure, are adjusted so as to achieve the desired impedance match. In particular, the electromagnetic field that forms in the volume of space between the floating coupling element and the resonant structure, and around the floating coupling element, provides the desired coupling between the load element and the resonant structure. The volume of space between the floating coupling element and the resonant structure can be regarded a second cavity, the resonant structure being the first cavity. The size, shape and other physical and electrical parameters of this second cavity determine the shape and behavior of the electromagnetic field and the coupling that it provides. The advantage provided by the floating coupling element derives from the availability of these parameters, that the antenna designer can adjust to achieve a particular coupling. The impedance match between the load element and the resonant structure depends on the coupling, and the flexibility provided by the floating coupling element makes it easier to achieve a good impedance match. Hereinafter we will refer to the floating coupling element as "floating element" with the understanding that its purpose is to provide coupling between the load element and the resonant structure.

In the prior art, both terminals of the load element are usually directly connected to one or more resonant structures. In some prior-art implementations, one or both terminals of the load element are not connected. Embodiments of the present invention achieve a better impedance match through the use of the floating coupling element. The ability to vary the shape, size and position of the floating coupling element provide antenna designers with additional parameters that they can adjust, through simulation or prototyping, to achieve the desired impedance match.

DETAILED DESCRIPTION

Figure 5:
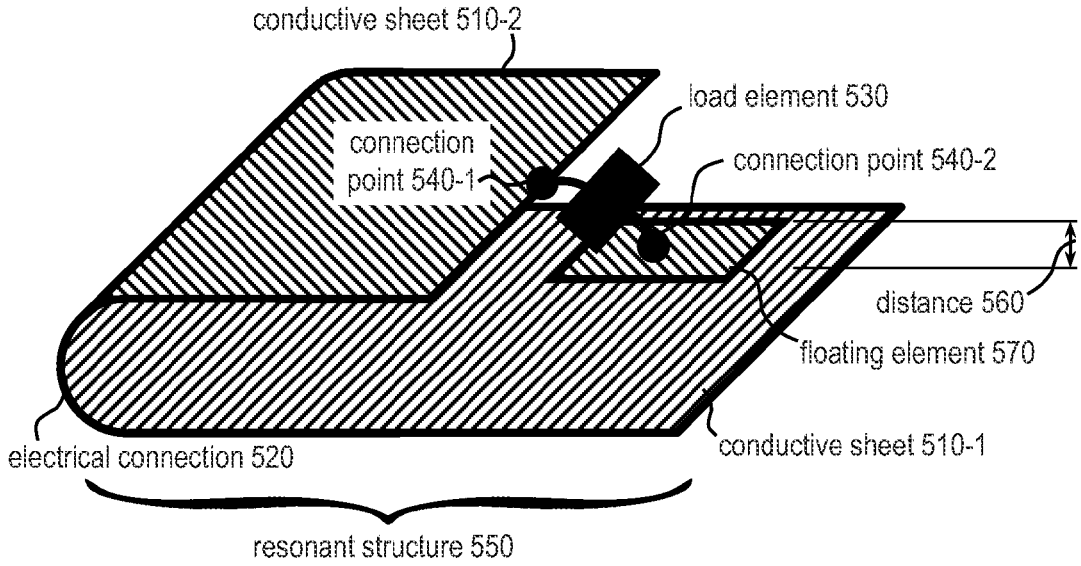
FIG. 5 depicts a single-cavity antenna with floating element in accordance with a first illustrative embodiment of the present invention.

FIG. 5 depicts single-cavity antenna with floating element 500 in accordance with a first illustrative embodiment of the present invention. Single-cavity antenna with floating element 500 comprises: conductive sheets 510-1, and 510-2, electrical connection 520, connection points 540-1 and 540-2, load element 530, and floating element 570, positioned and interrelated as shown. In particular, floating element 570 is a flat piece of conductive material parallel to, and at distance 560 from, conductive sheet 510-1; conductive sheets 510-1 and 510-2, together with electrical connection 520, form resonant structure 550; and load element 530 is electrically connected between resonant structure 550 and floating element 570 through connection points 540-1 and 540-2.

Figure 1:
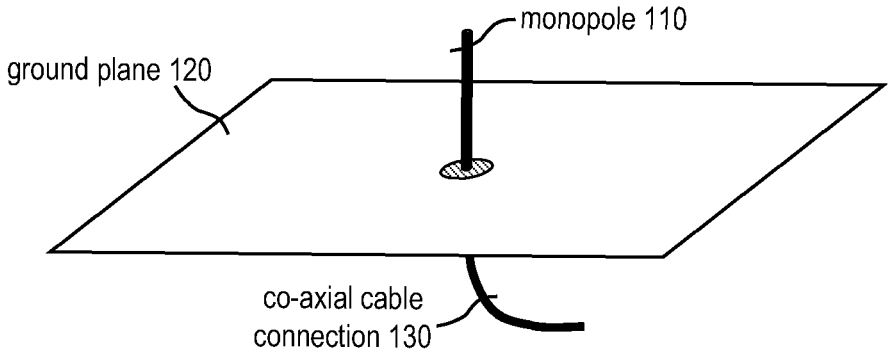
FIG. 1 PRIOR ART
FIG. 1 depicts a monopole antenna in the prior art.
Figure 2:
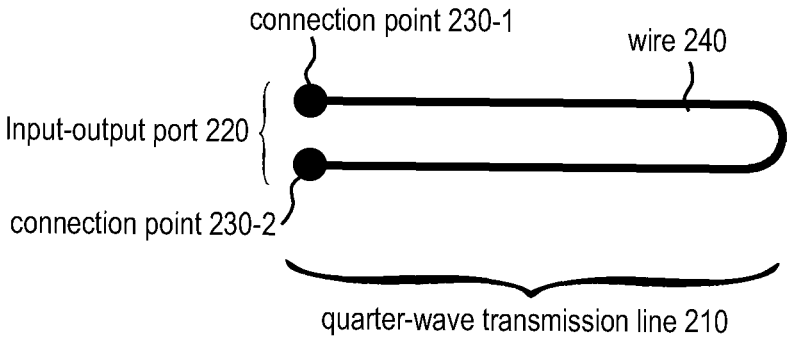
FIG. 2 PRIOR ART
FIG. 2 depicts a resonant structure in the prior art.
Figure 3:
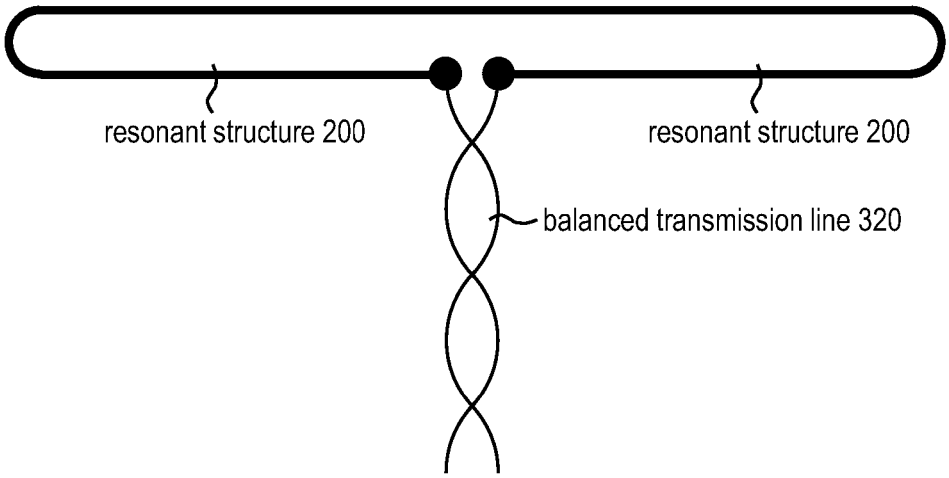
FIG. 3 PRIOR ART
FIG. 3 depicts a folded-dipole antenna in the prior art.
Figure 4:
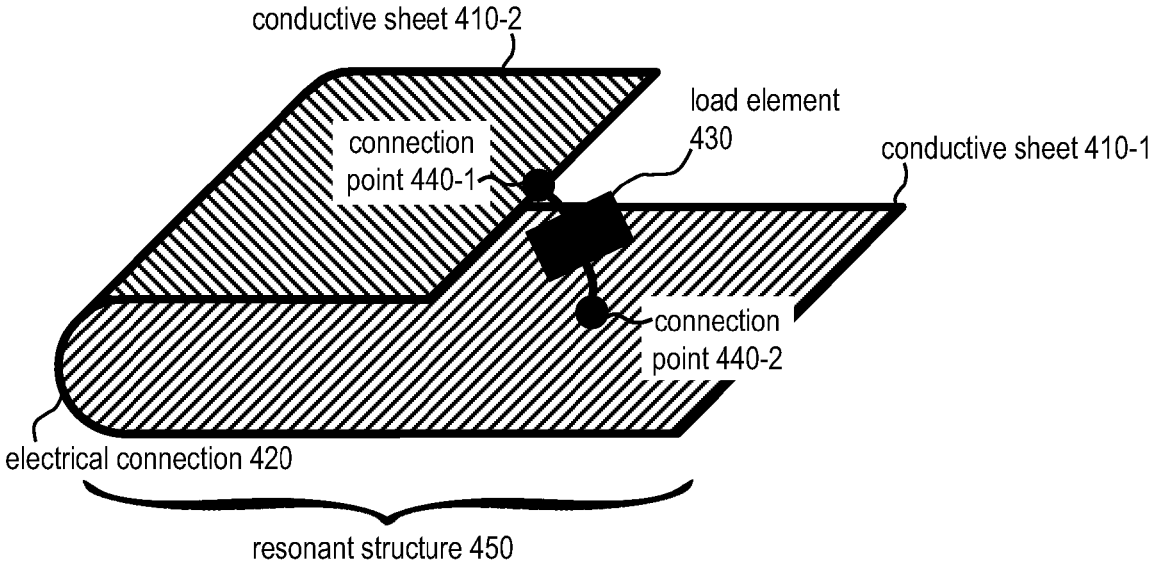
FIG. 4 PRIOR ART
FIG. 4 depicts an example of a type of antenna in the prior art for RFID tags.

Conductive sheets 510-1 and 510-2, and electrical connection 520 are identical to conductive sheets 410-1 and 410-2, and electrical connection 420 of FIG. 4. They form resonant structure 550, which is identical to resonant structure 450. But load element 530 can be different from load element 430 because it does not need to have the same impedance.

The purpose of floating element 570 is to couple connection point 540-2 to resonant structure 550 without the need for a direct electrical connection. Floating element 570 is electrically isolated from conductive sheet 510-1. Coupling between floating element 570 and conductive sheet 510-1 occurs through electro-magnetic fields that develop between floating element 570 and conductive sheet 510-1 when the antenna is used to receive a radio signal.

The size of floating element 570, and its distance from conductive sheet 510-1, are not negligible, compared to the size parameters of resonant structure 550. Examples of such size parameters are: the lengths and widths of conductive sheets 510-1 and 510-2, the distance between the two sheets, the relative position of one sheet with respect to the other. Because of its non-negligible size and distance from sheet 510-1, the impedance that is coupled to load element 530 is different from the impedance that is coupled to load element 430 in the prior art. The precise value of the impedance can be adjusted by varying the size and shape of floating element 570, and by varying its position relative to conductive sheet 510-1. The exact values that achieve a particular impedance that is desirable in a particular implementation can be derived through techniques well known in the art such as simulation or prototyping.

Although the shape of floating element 570 is depicted as a rectangle in FIG. 5, it will be clear to those skilled in the art, after reading this disclosure, how to make and use alternative embodiments of the present invention wherein the shape is different. In particular, the shape of floating element 570 affects the impedance coupled to load element 630, and it is one of the parameters that can be varied for the purpose of achieving a desired impedance. For example, and without limitation, the shape of floating element 570, can be a regular or irregular polygon, a circle or ellipse, a serpentine shape, a multi-pointed star.

Although floating element 570 is depicted as flat, it will be clear to those skilled in the art, after reading this disclosure, how to make and use alternative embodiments of the present invention wherein floating element 570 is not flat. For example, and without limitation: floating element 570 can be a piece of conductive material with non-negligible thickness, and its thickness can be an additional parameter that can be adjusted to achieve a desired impedance; floating element 570 can be shaped as a dome, or as a more complex three-dimensional structure; floating element 570 can be realized as one or more wires arranged in a three-dimensional shape, wherein the diameter of the wires can be an additional parameter that can be adjusted to achieve a desired impedance.

Although floating element 570 is depicted as parallel to conductive sheet 510-1, it will be clear to those skilled in the art, after reading this disclosure, how to make and use alternative embodiments of the present invention wherein floating element 570 is not parallel to conductive sheet 510-1. In particular, the exact angle and orientation of floating element 570 relative to conductive sheet 510-1 affect the impedance coupled to load element 530, and are additional parameters that can be varied for the purpose of achieving a desired impedance.

Although floating element 570 is depicted as floating unsupported in mid air relative to sheet 510-1, it will be clear to those skilled in the art how to support floating element 570. For example, and without limitation, non-conductive supporting devices such as plastic or teflon screws, or spacers; or glue can be used to support floating element 570. Alternatively, it is possible to make load element 530 with sufficient mechanical strength and rigidity such that the connection to load element 530 through connection point 540-2 is sufficient to support floating element 570 in the desired position. One alternative method to support floating element 570 is presented below as part of a second illustrative embodiment of the present invention. Other methods to support floating element 570 will be clear to those skilled in the art.

Although floating element 570 is depicted as being at a distance 560, from conductive sheet 510-1, that is less than the distance between sheet 510-1 and sheet 510-2, it will be clear to those skilled in the art, after reading this disclosure, how to make and use alternative embodiments of the present invention wherein floating element 570 is at a different distance. For example, and without limitation, floating element 570 can be in the same plane as sheet 510-2, so that distance 560 is the same as the distance between sheet 510-1 and sheet 510-2; or distance 560 can be larger than the distance between sheet 510-1 and sheet 510-2.

In an alternative embodiment of the present invention distance 560 between the plane of floating element 570 and the plane of conductive sheet 510-1 can be made to be at least one half of the distance between the plane of conductive sheet 510-2 and the plane of conductive sheet 510-1. In another alternative embodiment of the present invention the distance between the plane of conductive sheet 510-1 and the plane of conductive sheet 510-2 can be made to be less than: (i) the square root of the area of conductive sheet 510-1, and (ii) the square root of the area of conductive sheet 510-2. In another alternative embodiment of the present invention the distance between the plane of conductive sheet 510-1 and the plane of floating element 570 can be made to be less than: (i) the square root of the area of conductive sheet 510-1, and (ii) the square root of the area of floating element 570.

It will be clear to those skilled in the art, after reading this disclosure, how to make and use embodiments of the present invention wherein an antenna equivalent to the antenna depicted in FIG. 5 is realized by means of (a) a folded ribbon of conductive material, wherein an end of the ribbon is folded over the middle part of the ribbon; and (b) a patch of conductive material positioned near the folded end of the ribbon, parallel to the middle part of the ribbon, without touching the folded ribbon; wherein the distance between the folded end of the ribbon and the middle part of the ribbon is less than: (i) the length of the ribbon, and (ii) the width of the ribbon; and wherein the distance between the patch of conductive material and the middle part of the ribbon is less than: (i) the length of the ribbon, and (ii) the width of the ribbon. Furthermore, it will be clear to those skilled in the art, after reading this disclosure, how to make and use embodiments of the present invention wherein a load element is connected to such folded-ribbon antenna through a connection port that comprises a first electrical connection point on the folded end of the ribbon and a second electrical connection point on the patch of conductive material.

Figure 6:
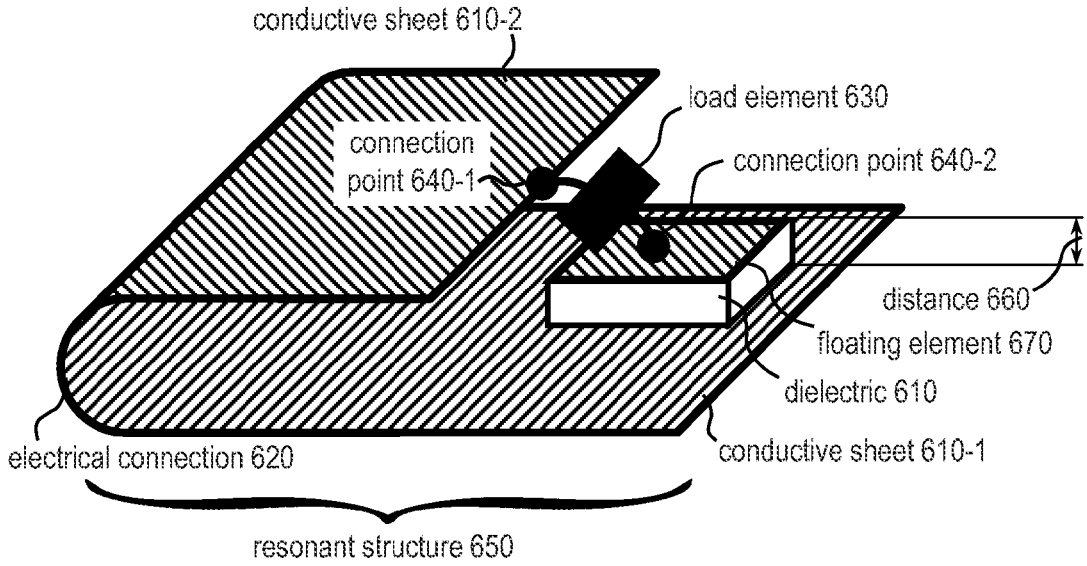
FIG. 6 depicts a single-cavity antenna with floating element and dielectric in accordance with a second illustrative embodiment of the present invention.

FIG. 6 depicts single-cavity antenna with floating element and dielectric 600 in accordance with a second illustrative embodiment of the present invention. Single-cavity antenna with floating element and dielectric 600 comprises: conductive sheets 610-1, and 610-2, electrical connection 620, connection points 640-1 and 640-2, load element 630, floating element 670, positioned and interrelated as shown.

Conductive sheets 610-1 and 610-2, and electrical connection 620 are identical to conductive sheets 510-1 and 510-2, and electrical connection 520 of FIG. 5. They form resonant structure 650, which is identical to resonant structure 550. Load element 630, connection points 640-1 and 640-2, and floating element 670 are identical, respectively, to load element 530, connection points 540-1 and 540-2, and floating element 570. The salient difference between this second embodiment and the first embodiment depicted in FIG. 5 is the presence of dielectric 610 between floating element 670 and conductive sheet 610-1.

Dielectric 610 is made of dielectric material whose dielectric properties provide additional parameters that can be varied for the purpose of achieving a desired impedance. Also, dielectric 610 can be made sufficiently strong to provide mechanical support for floating element 670.

Although dielectric 610 is depicted as having the shape of a parallelepiped whose size and shape match the size and shape of floating element 670, it will be clear to those skilled in the art, after reading this disclosure, how to make and use alternative embodiments of the present invention wherein dielectric 610 has other sizes and shapes. For example, and without limitation:

i. dielectric 610 can occupy only part of the space between floating element 670 and conductive sheet 610-1;
ii. dielectric 610 can extend beyond the outline of floating element 670 over portions of or over the entirety of the perimeter of floating element 670;
iii. dielectric 610 can comprise different regions made from different dielectric materials;
iv. dielectric 610 can be part of a printed-circuit board, resonant structure 650 can be realized as a patch antenna, and floating element 670 can be realized as a patch of conductive material; or
v. a combination of i, ii, iii, or iv.

Although FIG. 5 and FIG. 6 depict embodiments of the present invention comprising a single-cavity resonant structure, it will be clear to those skilled in the art, after reading this disclosure, how to make and use alternative embodiments of the present invention that comprise multiple resonant structures or multiple resonant cavities. Also, although the resonant cavities depicted in FIG. 5 and FIG. 6 do not comprise a dielectric, it will be clear to those skilled in the art, after reading this disclosure, how to make and use alternative embodiments of the present invention with resonant cavities that comprise a dielectric. For example, and without limitation, dielectric 610 can be realized as a single block of dielectric material that extends beyond the outline of floating element 670 and into the space between conductive sheets 610-1 and 610-2.

Although this disclosure sets forth embodiments of the present invention as applicable for implementing RFID systems, it will be clear to those skilled in the art, after reading this disclosure, how to make and use alternative embodiments of the present invention that are applicable to other types of radio-communication systems. For example, and without limitation, a radio receiver or transmitter characterized by a high input or output impedance can advantageously utilize an antenna with a floating coupling element in accordance with an embodiment of the present invention.

It is to be understood that this disclosure teaches just one or more examples of one or more illustrative embodiments, and that many variations of the invention can easily be devised by those skilled in the art after reading this disclosure, and that the scope of the present invention is to be determined by the following claims.

What is claimed is:

1. An antenna comprising:
a first flat sheet of conductive material in a first plane;
a second flat sheet of conductive material in a second plane that is parallel to the first plane;
a third flat sheet of conductive material in a third plane that is parallel to the first plane;
an electrical connection between a portion of the edge of the second sheet and the first sheet;
a connection port comprising a first electrical connection point on the second sheet and a second electrical connection point on the third sheet;
wherein the third sheet is electrically isolated from the first sheet;
wherein the distance between the third plane and the first plane is at least one half of the distance between the second plane and the first plane;
wherein the distance between the first plane and the second plane is less than:
(i) the square root of the area of the first sheet, and
(ii) the square root of the area of the second sheet;
wherein the distance between the first plane and the third plane is less than:
(i) the square root of the area of the first sheet, and
(ii) the square root of the area of the third sheet.

2. The antenna of claim 1 wherein the outline shape of the third sheet is within the outline shape of the first sheet.

3. The antenna of claim 2 wherein the outline shape of the second sheet is within the outline shape of the first sheet.

4. The antenna of claim 3 wherein the first sheet is rectangular in shape.

5. The antenna of claim 1 wherein a load element is connected between the first connection point and the second connection point.

6. The antenna of claim 5 wherein the load element comprises a rectifier for rectifying an electrical radiofrequency signal.

7. The antenna of claim 5 wherein the load element comprises a device with a controllable radiofrequency impedance.

8. The antenna of claim 1 wherein the volume of space between the first sheet and the second sheet comprises a dielectric material.

9. The antenna of claim 1 wherein the volume of space between the first sheet and the third sheet comprises a dielectric material.

10. The antenna of claim 1 wherein the outline shape of the second sheet does not extend beyond the outline shape of the first sheet.

11. The antenna of claim 1 wherein the outline shape of the third sheet does not extend beyond the outline shape of the first sheet.

12. An antenna comprising:
a ribbon of conductive material;
a patch of conductive material distinct from the ribbon of conductive material;
wherein an end of the ribbon is folded over the middle part of the ribbon;

wherein the patch of conductive material is positioned near the folded end of the ribbon, parallel to the middle part of the ribbon, without touching (i) the folded end of the ribbon, or (ii) the middle part of the ribbon;

wherein the distance between the folded end of the ribbon and the middle part of the ribbon is less than:

(i) the length of the ribbon, and (ii) the width of the ribbon; and wherein the distance between the patch of conductive material and the middle part of the ribbon is less than:

(i) the length of the ribbon, and (ii) the width of the ribbon.

13. The antenna of claim 12 further comprising:

a connection port comprising a first electrical connection point on the folded end of the ribbon and a second electrical connection point on the patch of conductive material.

14. The antenna of claim 12 wherein the volume of space between the folded end of the ribbon and the middle part of the ribbon comprises a dielectric material.

15. The antenna of claim 12 wherein the volume of space between the patch of conductive material and the middle part of the ribbon comprises a dielectric material.

16. An apparatus comprising:

an antenna with a connection port;

a load element connected to the connection port;

wherein the antenna comprises a ribbon of conductive material and, distinct from the ribbon of conductive material, a patch of conductive material;

wherein an end of the ribbon is folded over the middle part of the ribbon;

wherein the patch of conductive material is positioned next to the folded end of the ribbon, parallel to the middle part of the ribbon, without touching (i) the folded end of the ribbon, or (ii) the middle part of the ribbon;

wherein the distance between the folded end of the ribbon and the middle part of the ribbon is less than:

(i) the length of the ribbon, and (ii) the width of the ribbon;

wherein the distance between the patch of conductive material and the middle part of the ribbon is less than:

(i) the length of the ribbon, and (ii) the width of the ribbon;

wherein the connection port comprises a first electrical connection point on the folded end of the ribbon and a second electrical connection point on the patch of conductive material;

wherein the load element is electrically connected between the first electrical connection point and the second electrical connection point.

17. The apparatus of claim 16 wherein the load element comprises a rectifier for rectifying an electrical radiofrequency signal.

18. The apparatus of claim 17 wherein the load element comprises a device with a controllable radiofrequency impedance.

19. The antenna of claim 16 wherein the volume of space between the folded end of the ribbon and the middle part of the ribbon comprises a dielectric material.

20. The antenna of claim 16 wherein the volume of space between the patch of conductive material and the middle part of the ribbon comprises a dielectric material.

* * * * *